United States Patent [19]

Yamaryo

[11] Patent Number: 4,723,470

[45] Date of Patent: Feb. 9, 1988

[54] COUPLING UNIT FOR A WOODWIND

[75] Inventor: Shigeru Yamaryo, Hamamatsu, Japan

[73] Assignee: Nippon Gakki Seizo Kabushiki Kaisha, Japan

[21] Appl. No.: 852,560

[22] Filed: Apr. 16, 1986

[30] Foreign Application Priority Data

Apr. 24, 1985 [JP] Japan ..... 60-60192[U]

[51] Int. Cl.[4] ..... G10D 7/06

[52] U.S. Cl. ..... 84/380 R; 84/382

[58] Field of Search ..... 84/380 R, 380 A, 382, 84/384

[56] References Cited

U.S. PATENT DOCUMENTS 2,208,838 7/1940 Ely ..... 84/382

*Primary Examiner*—Lawrence R. Franklin

*Attorney, Agent, or Firm*—Ostrolenk, Faber, Gerb & Soffen

[57] ABSTRACT

At assembly of a woodwind such as a clarinet, an annular projection on a joint ring of the first joint abuts against the second ring key on the second joint which is thereupon pushed off the path of movement of the first ring key on the first joint, whereby crash of the ring keys is successfully obviated even at careless assembly.

4 Claims, 5 Drawing Figures

COUPLING UNIT FOR A WOODWIND

BACKGROUND OF THE INVENTION

The present invention relates to an improved coupling unit for a woodwind, and more particularly relates to an improvement in coupling structure of lower and upper joints on a woodwind such as a clarinet, an oboe and a bassoon.

In construction of a wood wind, a lower joint carries a first ring key and an upper joint carries a second ring key and, when the lower joint is coupled to the upper joint assembly, these ring keys are both located close to the point coupling. As a consequence, careless coupling of the lower the upper joints tends to cause the fist ring keys to snap against one another. When the ring keys bend considerably due to such snapping contact, they cannot be operated smoothly, thereby preventing generation of sounds. Such an accident is liable to occur especially when the woodwind is handled by unskilled players.

SUMMARY OF THE INVENTION

It is the object of the present invention to avoid the ring keys from snapping against one another even when joints on a woodwind are coupled together without any particular attention.

In accordance with the present invention, an annular projection is formed on a joint ring attached to the coupling end of the first joint and the second ring key arranged near the coupling end of the second joint is provided with a recess receptive of the annular projection so that, at coupling of the two joints, the annular projection on the first joint provisionally pushes the second ring key on the second joint off the path of movement of the first ring key on the first joint.

DESCRIPTION OF THE PREFERRED EMBODIMENTS

Figure 1:
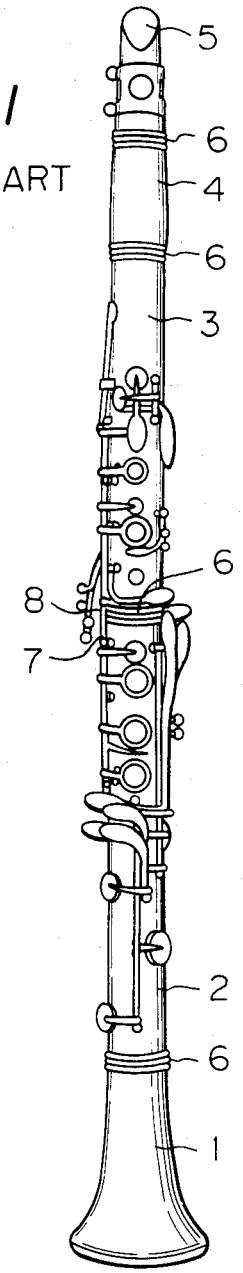
Fig. 1 PRIOR ART
FIG. 1 is a side view of a conventional clarinet.
Figure 2:
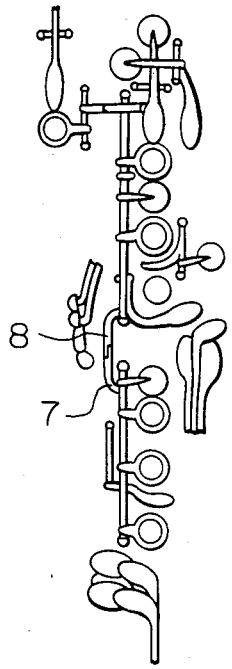
FIG. 2 is a side view of ring keys.

As one example of the woodwinds to which the present invention is well applied, a clarinet is shown in FIG. 1, in which the conventional clarinet includes a bell 1, a lower joint 2, an upper joint 3, a barrel 4 and a mouthpiece 5 coupled to each other via joint rings 6.

At assembly, the lower joint 2 is first coupled to the upper joint 3. Then, a first ring key 7 on the lower joint 2 and a second ring key 8 on the upper joint 3 are both located close to coupling ends. When it is difficult to couple the joints smoothly, a joint cork on the upper joint is grease rubbed for softening. Next, the barrel 4, bell 1 and the mouthpiece 5 are coupled together in the described order.

Figure 3:
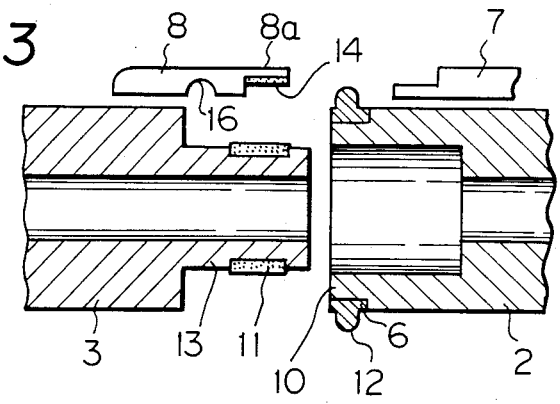
FIG. 3 is a side view, partly in section, of one embodiment of the coupling unit in accordance with the present invention with two joints being separated and the ring keys only partially shown for simplicity of illustration.

One embodiment of the coupling unit in accordance with the present invention is shown in FIG. 3 in a disassembled state. The lower joint 2 includes a coupling end 10 of a reduced diameter over which a metallic joint ring 6 is force inserted. On the outer face, the joint ring 6 is provided with an annular projection 12. As with conventional ring keys, the ring key 7 is attached to the lower joint 2 near the coupling end 10.

The upper jont 3 includes a coupling end 13 of a reduced diameter which outwardly bears a joint cork 11. As with conventional ring keys, the ring key 8 is attached to the upper joint 3 near the coupling end 13. At the distal end 8*a*, the ring key 8 is inwardly provided with a cork 14. Further, on the side facing the coupling end 13 of the upper joint 3, the ring key 8 is provided with a recess 16 which is shaped to receive the annular projection 12 on the joint ring 6 when both joints 2 and 3 are fully coupled to each other.

The outermost diameter of the annular projection 12 on the joint ring 6 is selected so that, when the lower joint 2 is inserted over the coupling end 13 of the upper joint 3, the annular projection abuts against the distal end 8*a* of the ring key 8.

Figure 4A:
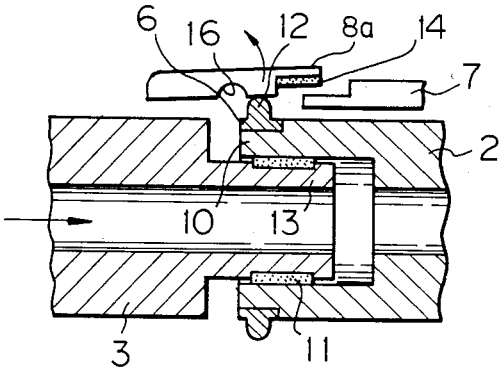
FIGS. 4A and 4B are side views, partly in section, of the coupling unit in FIG. 3 at assembly of the clarinet and the ring keys only partially shown for simplicity of illustration.

FIG. 4A depicts the initial stage of coupling of the two joints 2 and 3. As stated above, the annular projection 12 on the joint ring 6 abuts against the distal end 8*a* of the ring key 8 and, due to its round configuration, pushes the ring key 8 outwards. In other words, the ring key 8 on the upper joint 3 is placed out of the path of movement of the ring key 7 on the lower joint 2 and, as a consequence, the ring key 7 moves without snapping against the ring key 8 during further insertion of the lower joint 2.

Figure 4B:
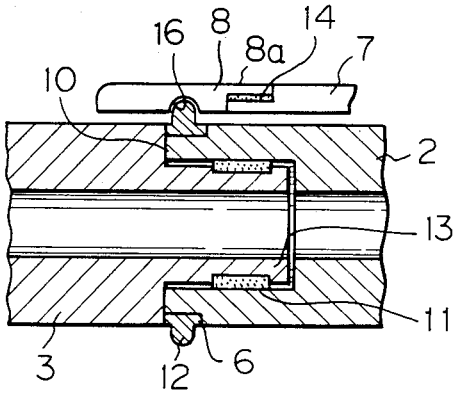

When the two joints 2 and 3 are fully coupled to each other as shown in FIG. 4B, the annular projection 12 on the joint ring 6 is received in the recess 16 on the ring key 8 which then resumes the initial position shown in FIG. 3.

The distance of the outward movement of the ring key 8 should preferably be in a range from 0.5 to 1 mm which can be easily obtained by proper adjustment in setting of the ring key 8.

I claim:

1. An improved coupling unit for a woodwind, comprising:

a first joint bearing a first ring key;

a joint ring inserted over a coupling end of said first joint, said joint ring including an annular projection provided on its entire circumferential outer face; and a second ring key attached to a coupling end of a second joint and provided with a recess adapted to receive said annular projection when said first and second joints are fully coupled to each other.

2. An improved coupling unit as claimed in claim 1 in which the outermost diameter of said annular projection on said joint ring is selected so that, when said first joint is inserted over said coupling end of said second joint, said annular projection abuts against the distal end of said second ring key.

3. An improved coupling unit as claimed in claim 2 in which said second ring key is moved outwards over a distance from 0.5 to 1.0 mm as a result of abutment against said annular projection on said joint ring.

4. An improved coupling unit as claimed in claim 1 in which said annular projection extends a constant distance from said outer face of said joint ring.

* * * * *